United States Patent [19]

Kay

[11] 4,452,364

[45] Jun. 5, 1984

[54] SAFETY CLOSURE DEVICE FOR MEDICINE CONTAINER

[76] Inventor: Ronald D. Kay, 3513 Hazeline Rd., Fort Worth, Tex. 76103

[21] Appl. No.: 464,406

[22] Filed: Feb. 7, 1983

[51] Int. Cl.[3] ..... B65D 39/04

[52] U.S. Cl. ..... 215/253; 215/258

[58] Field of Search ..... 215/253, 256, 258, 214, 215/211; 220/268

[56] References Cited

U.S. PATENT DOCUMENTS 3,251,499 5/1966 Rausing et al. ..... 215/253
3,865,267 2/1975 Morris ..... 215/214 X
4,343,408 8/1982 Csaszar ..... 215/258

FOREIGN PATENT DOCUMENTS 1432208 12/1968 Fed. Rep. of Germany ..... 215/253
1564034 3/1969 France ..... 215/253

*Primary Examiner*—Donald F. Norton
*Attorney, Agent, or Firm*—James E. Bradley

[57] ABSTRACT

A medicine container has a closure to prevent tampering prior to sale. A lock ring has a closure integrally formed to it for enclosing the contents of the container. A locking device is formed on the lock ring and on the container sidewall so as to allow the lock ring to be pushed into the container, but preventing its removal without destroying the container or the lock ring. An annular score line is provided between the lock ring and the closure. This score line allows opening of the contents by breaking the closure from the lock ring, which then remains with the container. A conventional cap can then be secured to the sidewall of the container for subsequent use.

5 Claims, 5 Drawing Figures

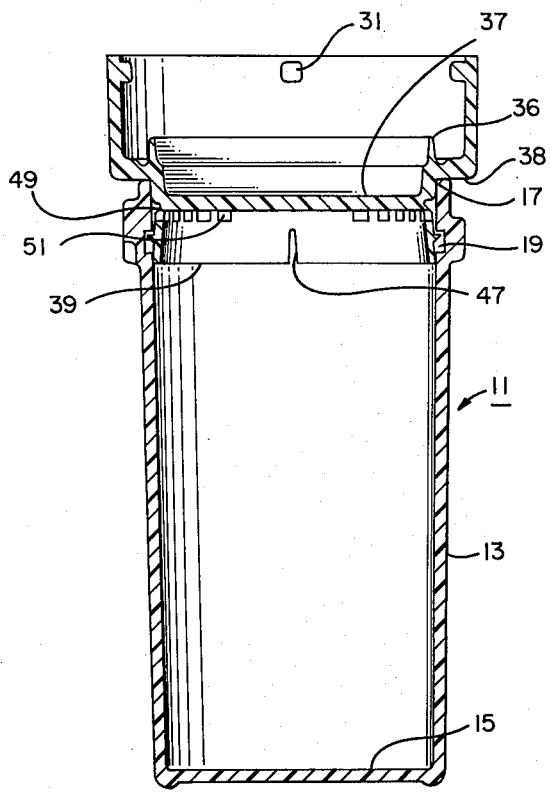
FIG. 1
FIG. 2
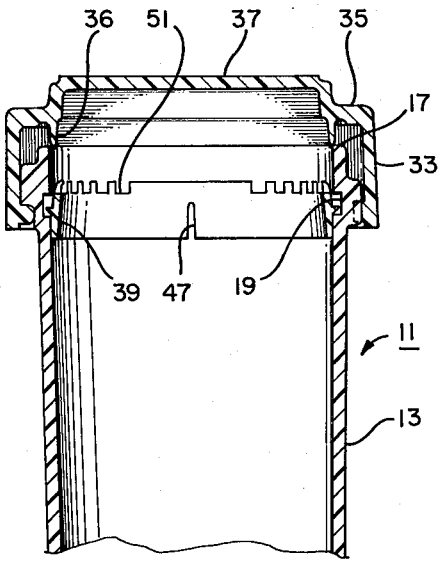
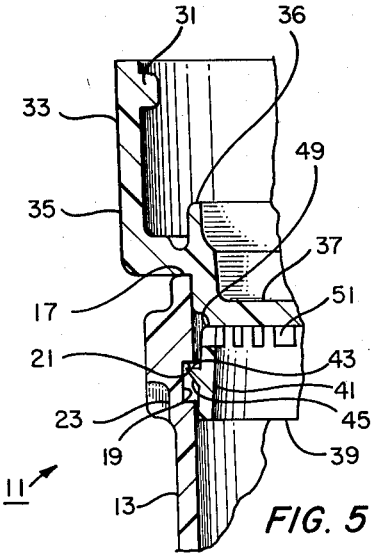
FIG. 5

SAFETY CLOSURE DEVICE FOR MEDICINE CONTAINER

BACKGROUND OF THE INVENTION

1. Field of the Invention

This invention relates in general to medicine vials or containers, and in particular to a closure means to resist tampering.

2. Description of the Prior Art

Recently, there have been instances where the contents of medicine containers have been tampered with prior to their sale. Tragic instances have occurred where capsules have been emptied of their contents and filled with poisonous substances, then placed back on the shelf for purchase by an unsuspecting victim. Liquid medicines such as eye wash have been tampered with by the introduction of acid and other dangerous chemicals.

As a result, efforts are being made to seal the contents such that a purchaser would easily be able to detect whether or not tampering had occurred. Generally, these solutions are not fool-proof. One solution is to utilize tightly stretched aluminum foil across the top of the container. Other solutions include wrapping the container or carton in paper or plastic film. While these efforts will make the containers more resistant to tampering, a skilled person having only a small amount of equipment would still be able to carefully open the contents and reseal the container without detection by most purchasers.

SUMMARY OF THE INVENTION

A container closure device is provided that will be extremely resistant to tampering. The closure device includes a lock ring that has a closure means or lid integrally formed with it for hermetically enclosing the contents of the container. Locking means are formed on the lock ring and the container for immovably securing the lock ring to the sidewall of the container by pressing the container and lock ring together. Once pressed together, the lock ring cannot be pulled from the container without destroying part of the lock ring, thus sealing the container. An annular score line provides a weakened wall area for breaking the closure means from the container to provide access. Securing means is located on the sidewall of the container to then secure a conventional cap, once the closure means has been broken from the container.

BRIEF DESCRIPTION OF THE DRAWINGS

FIG. 1 is a vertical sectional view of a container and closure device constructed in accordance with this invention, as shown prior to the initial opening.

FIG. 2 is a vertical sectional view of the container of FIG. 1, as shown after the container has been initially opened.

FIG. 5 is an enlarged, partial sectional view of the container of FIG. 1, shown after sealing and prior to the initial opening.

DESCRIPTION OF THE PREFERRED EMBODIMENT

Figure 4:
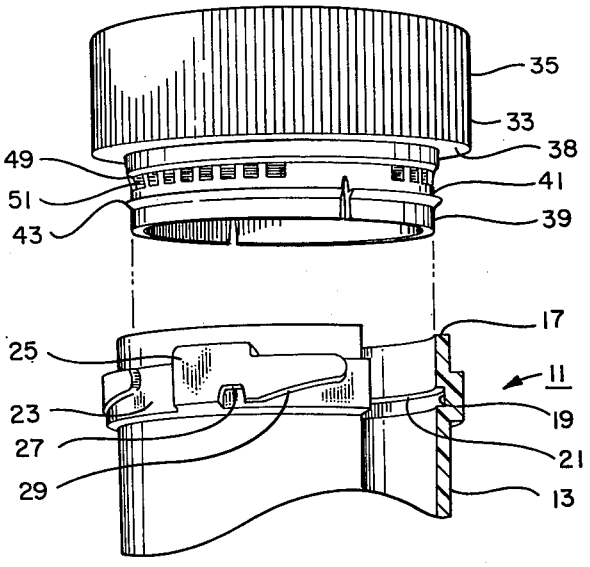
FIG. 4 is a partial exploded view of the container of FIG. 1 prior to the initial sealing.

Referring to FIG. 1, container 11 is a vial or bottle normally used to hold tablets or capsules of medicine. Container 11 may be of various shapes and is shown having a cylindrical sidewall 13, a closed bottom 15 and an open top 17. An annular recess 19 is formed in the interior of sidewall 13 a short distance below the upper edge or top 17. Recess 19 is perpendicular to the longitudinal axis of container 11 and is rectangular in vertical cross-section. As shown in FIG. 4, the upper side of recess 19 is a downwardly facing shoulder 21. To avoid reducing the wall thickness of sidewall 13 at recess 19, a thickened section or band 23 extends around the exterior of sidewall 13 adjacent recess 19.

Figure 3:
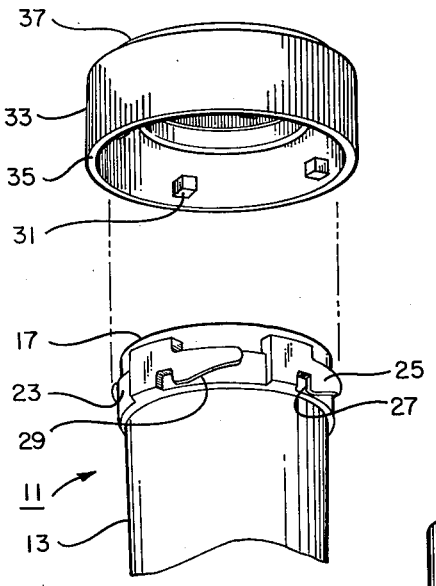
FIG. 3 is an exploded, partial perspective view of the container of FIG. 1 after the initial opening.

Container 11 has a plurality of lugs 25 spaced circumferentially around sidewall 13 on the exterior side, and located on band 23. Each lug 25 is of a conventional type having a downwardly facing recess 27 and a lower tapered edge 29. Each lug 25 is adapted to receive a dog 31 (FIG. 3) formed on the interior of a sidewall 33 of a cap 35. Dogs 31 are small protruberances that will slide down the tapered edge 29 and latch into the recess 27. An annular lip 36, as shown in FIG. 2 extends from the interior of cap 35 and interferingly fits within the top 17 of container 11 to provide an upward bias to retain the dogs 31 in the recesses 27. The lip 36 will deform inwardly slightly when the cap 35 is pushed downwardly to allow the dogs 31 to slide down the inclined edge 29 into the recesses 27. Once pressure is released, the lip 36 tends to push the cap 35 back upwardly. Lugs 25, lip 36 and dogs 31 comprise conventional securing means for securing a cap to a container so as to make it difficult for young children to open the contents of the container.

Referring to FIG. 1, when the contents of container 11 are initially introduced into the container, and the container is shipped for resale, the top 37 of cap 35 will be oriented downward, with the interior facing upwardly. Dogs 31 will not be in engagement with the lugs 25. An annular shoulder or corner 38 that surrounds the top 37 will be facing downwardly and in contact with the upper edge 17 of container 11. The top 37 will be integrally formed to a lock ring 39, normally by injection molding.

Referring to FIG. 5, lock ring 39 is an annular ring having a sidewall 41 with an outer diameter that is closely and tightly received within the inner diameter of the container sidewall 13. The exterior side of sidewall 41 has an annular shoulder 43 that faces upwardly and has an outer diameter that is larger than the inner diameter of sidewall 13. Shoulder 43 is adapted to mate with and engage the downwardly facing shoulder 21 of the container recess 19. A tapered surface 45 extends from the outer edge of shoulder 43 downwardly to facilitate entry of the shoulder 43 into the container 11. Lock ring 39 will deform to a slight extent, being of a plastic material, to allow the pressing of the lock ring 39 into the container 11, although a fair amount of force will be required. To facilitate the deformation, a plurality of vertical slots 47, shown in FIG. 1, extend through sidewall 41 of lock ring 39 from the lower edge a selected distance upward.

A score line 49 is formed at the junction between the lock ring 39 and the cap top 37, which serves as closure means for hermetically sealing the contents of the container 11. Score line 49 is a weakened area of reduced wall thickness extending completely around the lock ring 39 upper edge to facilitate breaking of the cap 35 from the lock ring 39 at this point. Also, if desired, a plurality of perforations 51 may be spaced around the score line 49 to even further weaken this wall area.

In operation, at the factory where the contents are to be placed in the container 11, the container 11 and cap 35 with its lock ring 39 will be in separate pieces, as shown in FIG. 4. After the contents have been placed in container 11, a press (not shown) will be used to press the cap 35 and lock ring 39 to the container 11. As shown in FIG. 4, the lock ring 39 will slide into the interior of sidewall 13, deforming inwardly. Once shoulder 43 reaches recess 19, it will spring outward, locking the lock ring 39 permanently to the container 11. The top 37 will enclose the contents of the container 11, as shown in FIG. 1. The interior of cap 35 will face upwardly.

Once the container is purchased, the user then pries the cap 35 from the container 11 by a prying action between the shoulder 38 and the upper edges of the lugs 25. A coin placed between the corner 38 and lug 25 upper edge and twisted will be sufficient to cause the score line 49 to part. This removes the top 37 and cap 35 from the lock ring 39, which remains with the container 11. Access to the contents is thereby provided.

To again close the contents, the user inverts the cap 35, presses downwardly and rotates slightly to cause the dogs 31 to pass between lugs 35, then slide down the edge 29 into the recesses 27. This secures the cap to the container. To reopen, the user presses downwardly in a conventional manner to free the dogs 31 from the recesses 27, then rotates outwardly and pulls upwardly.

It should be apparent that the invention has significant advantages. Securing a closure means to a lock ring, then pressing the lock ring into the container so that it cannot be removed allows the purchaser to detect tampering. It would not be possible to remove the lock ring from the container without breaking the closure at the score line, thus informing any subsequent purchaser that tampering had occurred. Once the container has been initially opened, securing means provided on the outside of the container allows a conventional cap to be secured to the container. A cap of a "child proof" design can be formed with the closure and lock ring and inverted for normal usage.

While the invention has been shown in only one of its forms, it should be apparent to those skilled in the art that it is not so limited but is susceptible to various changes without departing from the scope of the invention.

I claim:

1. In a container of the type having a plurality of lugs spaced around the upper edge of the container, each having a recess on its lower side for receiving a dog of a cap to secure the cap, an improved means for indicating whether tampering of the contents of the container has occurred prior to use, comprising:

a downwardly facing annular shoulder formed in the interior of a sidewall of the container;

a lock ring having a sidewall with an exterior dimensioned for a close reception within the sidewall of the container;

an upwardly facing shoulder formed in the exterior of the lock ring sidewall, protruding an amount greater than the inner diameter of the sidewall of the container;

the lock ring being deformable, and a selected one of the sidewalls having a tapered portion to facilitate movement of the lock ring shoulder past the container shoulder when pressing the lock ring into the container, the shoulders engaging to prevent upward movement of the lock ring with respect to the container;

the cap having a top integrally formed to the lock ring, with the interior of the cap facing upwardly; and annular score line means formed between the cap and lock ring, providing a weakened area for breaking the cap from the lock ring for providing access to the contents and allowing the cap to be inverted and secured to the lugs of the container.

2. The container according to claim 1, wherein the shoulder of the container is located within an annular recess formed in a thickened section of the container sidewall, and wherein the tapered portion is located in the side wall of the lock ring, extending downwardly from the shoulder of the lock ring.

3. The container according to claim 1, further comprising:

a plurality of vertical slots extending through the sidewall of the lock ring to facilitate deformation of the lock ring.

4. A container having an improved means for indicating whether tampering of the contents of the container has occurred prior to use, comprising in combination:

a lock ring having a sidewall dimensioned for close sliding reception within a sidewall of the container;

a cap having a top integrally formed to the lock ring, with the interior of the cap facing upwardly, the cap having securing means formed in an interior sidewall for engaging securing means provided on the exterior of the sidewall of the container;

locking means formed on the sidewalls of the lock ring and the container for allowing the lock ring to be pressed into the container but preventing removal of the lock ring; and annular score line means formed between the cap and lock ring, providing a weakened area for breaking the cap from the lock ring for providing access to the contents and allowing the cap to be inverted and secured to the container with the securing means.

5. A container having an improved means for indicating whether tampering of the contents of the container has occurred prior to use, comprising:

an annular recess formed in the interior of a sidewall of the container, defining a downwardly facing annular shoulder located in a plane perpendicular to the axis of the container;

a lock ring having a sidewall with an exterior dimensioned for close reception within the sidewall of the container;

an upwardly facing shoulder formed in the exterior of the lock ring sidewall in a plane perpendicular to the axis of the lock ring, the lock ring being deformable and having a tapered portion extending from the lock ring shoulder downwardly and inwardly to facilitate movement of the lock ring shoulder past the container shoulder when pressing the lock ring into the container, the shoulders engaging to prevent upward movement of the lock ring with respect to the container;

a closure means integrally formed with the lock ring for hermetically enclosing the contents of the container; and annular score line means formed between the closure means and the lock ring, providing a weakened area for breaking the closure means from the lock ring for providing access to the contents of the container.

* * * * *